US005661947A

United States Patent [19]

Ippy et al.

[11] Patent Number: 5,661,947

[45] Date of Patent: Sep. 2, 1997

[54] PROCESS TO TRAVERSE A FLAT CAN WHILE BEING FILLED AT A TEXTILE MACHINE DELIVERING A FIBER SLIVER AND ITS DEVICE

[75] Inventors: Josef Ippy, Mainburg; Otmar Kovacs, Dietfurt; Michael Ueding, Ingolstadt; Albert Kriegler, Rottenegg, all of Germany

[73] Assignee: Rieter Ingolstadt Spinnereimaschinenbau AG, Ingolstadt, Germany

[21] Appl. No.: 622,926

[22] Filed: Mar. 27, 1996

Related U.S. Application Data

[63] Continuation of Ser. No. 273,015, Jul. 8, 1994, abandoned.

[30] Foreign Application Priority Data

Jul. 24, 1993 [DE] Germany ..... 43 24 951.5

[51] Int. Cl.[6] ..... B65B 63/04

[52] U.S. Cl. ..... 53/118; 53/116; 53/245; 53/249; 19/159 R

[58] Field of Search ..... 19/159 A, 159 R, 19/160; 141/168, 283; 53/116, 118, 245, 249, 429, 430, 473

[56] References Cited

U.S. PATENT DOCUMENTS

| | | | |
|---|---|---|---|
| 2,971,244 | 2/1961 | Foller et al. | 53/116 |
| 3,339,244 | 9/1967 | Van Deusen | 19/160 |
| 3,423,807 | 1/1969 | Couturier et al. | 53/116 |
| 4,432,118 | 2/1984 | Rosink | 19/159 R |
| 4,628,972 | 12/1986 | LaRochelle | 141/168 X |
| 4,960,156 | 10/1990 | Tribert | 141/168 X |
| 5,237,726 | 8/1993 | Gartenmann et al. | 19/159 A X |
| 5,528,797 | 6/1996 | Otmar et al. | 19/159 R |

FOREIGN PATENT DOCUMENTS

| | | | |
|---|---|---|---|
| 0457099B1 | 5/1991 | European Pat. Off. . | |
| 0459956 | 12/1991 | European Pat. Off. . | |
| 1923621 | 1/1973 | Germany . | |
| 325660 | 2/1930 | United Kingdom | 19/159 R |
| 812644 | 4/1959 | United Kingdom . | |
| 1258009 | 12/1971 | United Kingdom . | |

*Primary Examiner*—Daniel Moon
*Attorney, Agent, or Firm*—Dority & Manning

[57] ABSTRACT

The invention relates to the filling of a flat can with fiber sliver by a textile machine which delivers a fiber sliver, such as a carding machine or a draw frame, whereby the flat can is moved under a stationary, rotating rotary plate. The invention significantly reduces the costs for the required movements of the flat can as compared to the state of the art. The process according to the invention for the traversing of a flat can during the filling process at a textile machine delivering a fiber sliver is realized in that the flat can is shifted laterally by tilting of the flat can around an axis in the return path of the traversing path. In the device according to the invention, the traversing mechanism is equipped with a tilting device. For this purpose, the tilting device is provided with a tilter and an axis around which the flat can is tilted.

37 Claims, 9 Drawing Sheets

PROCESS TO TRAVERSE A FLAT CAN WHILE BEING FILLED AT A TEXTILE MACHINE DELIVERING A FIBER SLIVER AND ITS DEVICE

This is a continuation, of application Ser. No. 08/273,015, filed Jul. 8, 1994, which was abandoned upon the filing hereof.

BACKGROUND OF THE INVENTION

The instant invention relates to the filling of a flat can with fiber sliver by a textile machine which delivers a fiber sliver, such as a carding machine or draw frame, whereby the flat can is moved beneath a rotary plate rotating in one place. The movement of the can influences the quality of the deposited fiber sliver and the degree of can fullness.

According to the state of the art, flat cans are filled in that a rotary plate functioning as a delivery device rotates in one place, the flat can being moved back and forth beneath this rotary plate. In other words, the flat can is traversed below the rotary plate. During the traversing of the flat can its speed is synchronized with the delivery speed of the fiber sliver. The back-and-forth movements of the flat can are carried out at a constant speed as far as the reversal point. In executing this movement, the flat can together with its supporting surface assumes an even position.

In order to attain a higher degree of can fullness with a defined quality of fiber sliver to be deposited, it was proposed in the state of the art (compare EP 457 099, column 4, 26th to 33rd line) to combine the straight-line traversing movement of the flat can with a lateral transversal movement. EP 457 099, column 12, lines 35–39 assumes that the lateral, translational transversal shifting of the flat can is able to increase the degree of fullness by shifting the loop deposit of the fiber sliver. This fact is significant since the can serves at the same time as a buffer storage between draw frame and rotor spinning machine so that its transportation frequency decreases as the degree of fullness increases. EP 457 099, column 4, lines 26–31 proposes in this context that the flat can be shifted by a lateral transversal movement upon passing the respective cuspidal point, whereby the shifting distance is approximately equal to the thickness of a fiber sliver. The document (EP 457 099, column 12, lines 39–42) gives no information concerning technological feasibility, but according to the state of the art the utilization of rail-travelling carriages (DE-OS 19 23 621) is possible in order to traverse the flat can as well as to enable the appertaining lateral transversal shifting.

DE-OS 19 32 621 describes how the transversal shift is carried out by two conveying devices (upper carriage and lower carriage) controlled independently of each other. The long can is here standing on the upper carriage. The directions of movement between the lower carriage and the upper carriage are arranged so that they can be executed at a right angle to each other. The lower carriage carries out the traversing movement and the upper carriage carries out the straight-line, lateral transversal shift of the flat can. In this document, it is stated that the two directions of movement are to be superimposed so that a resultant direction of movement follows.

It is characteristic for these solutions of the state of the art that the lateral shift of the flat can is a translational motion. This translational lateral shift of the flat can is obtained at a relatively high cost. The disadvantageous cost is due to the additional two carriages and to their control. It is a disadvantage here that the inert mass to be moved increases unnecessarily.

As the degree of fullness of the flat can increases, the problem of inertia forces being produced together with the translational lateral shift further arises, the inertia forces having to be absorbed by the flat can and the traversing apparatus. This requires correspondingly large dimensions of the flat can and of the traversing apparatus, which results in higher costs.

OBJECTS AND SUMMARY OF THE INVENTION

It is a principal object of the instant invention to significantly reduce the costs arising in the state of the art for the movements of the flat cans. Additional objects and advantages of the invention will be set forth in part in the following description, or will be obvious from the description, or may be learned through practice of the invention.

A textile machine delivering a fiber sliver may be a carding machine or a draw frame. The delivery device is a stationary rotary plate which deposits the fiber sliver in cycloidal fashion in the flat can as a result of its rotation. The flat can is moved below the rotary plate in order to be filled. The process for the traversing of a flat can according to the invention during the filling process at a textile machine delivering a fiber sliver is realized in that the flat can is shifted laterally in the return path of the traversing movement by tilting the flat can around an axis.

The return path of the traversing movement is part of the traversing path. The traversing path for the flat can is the distance between two cuspidal points. If the flat can moves towards one cuspidal point, it is braked in immediate proximity before the cuspidal point and is accelerated for a short distance immediately upon passing the cuspidal point. These distances for braking and acceleration in the immediate proximity of the cuspidal point are called the return path. The movement of the flat can between the two cuspidal points is an essentially uniform movement. In the return path, the flat can is tilted from one side to the other side around a defined axis. The flat can is tilted in the return path by such an angle that the upper can rim, which is formed by the can bead, is offset laterally. This offset of the upper can rim is essential, for it is in the area of this upper can rim that the fiber sliver loops are always deposited. The depositing surface formed between the upper can rim is shifted laterally due to the tilting motion. This makes it possible for the sliver deposit by the rotary plate to be carried out with a lateral offset in relation to the original position (basic position) of the flat can. This lateral offset can be adjusted and is approximately equal to the thickness of the fiber sliver to be processed. During the tilting movement, the flat can leaves its basic position. The basic position is characterized in that the depositing surface of the flat can is parallel to the base surface of the flat can. In its tilted position, the flat can is traversed to the opposite cuspidal point. The tilting angle assumed by the flat can away from its basic position is reversed when the opposite return path is reached. The flat can tilts around the axis into the other direction and is again traversed in this tilted position to the opposite return path.

It is an advantage of the invention that the tilting motion in the form of a lateral transversal shift of the flat can is less expensive, from the technological cost point of view, than the known translational lateral shift. The cost is thus reduced significantly. It is a further advantage that the forces of inertia which have a disadvantageous effect upon the filling process, in particular during the reversal of the traversing apparatus, are also compensated for to considerable advantage. According to the process, the size of the angle by which the flat can is to be tilted can be adjusted. Normally the flat can is tilted by the same angle to one side and to the other. This angle can be varied and adjusted. This is useful when changing fiber sliver material as a result of a batch change. The possibility of influencing the effects on fiber sliver deposit that result from the reciprocal action between the depositing direction of the fiber sliver and the direction of movement of the long lateral side is a further advantage. It is yet another advantage that unequal angles can be set for tilting, i.e. the angle of rotation to one side is not equal to the angle of rotation to the other side. This makes it possible to compensate for deviation from center between flat can and rotary plate.

In the device according to the invention, the traversing apparatus is equipped with a tilting device. For this purpose, the tilting device is equipped with tilters and with an axis around which the flat can is tilted as operating means. The tilters are located on either side of the traversing path of a flat can. The arrangement, in relation to the flat can, is such that the tilters are located on either side near the longitudinal side of a flat can. Either tilter may be placed in a position relative to the longitudinal side which is between the upper can rim and contacting grasping plate of the traversing apparatus or between the lower can rim and contacting grasping plate. The placement of the tilters in relation to the longitudinal sides of the flat can may also depend on the selection of the tilting axis.

The tilters make it possible to tilt around a tiling axis. The tilters supply the force for tilting and the direction of force directed upon the flat can. The tilters may be arranged advantageously in a horizontal plane in relation to each other. The tilters provide at the same time guidance for the flat can during traversing. When the flat can reaches a cuspidal point of its traversing path as it traverses, the two tilters tilt the flat can by a defined angle in a defined direction. The flat can is held in this position and led back to the other cuspidal point as it is traversed. When the other cuspidal point is reached, the tilters tilt the flat can into the opposite angle position. This process is repeated until the can is full and a can replacement is indicated.

The tilting device can tilt the flat can in a traversing apparatus in a suspended position. The flat can may however also be tilted on a conveyor which assists traversing, or the flat can and appertaining conveyor can be tilted together.

In an advantageous embodiment, the flat can is standing on a conveyor to be tilted. The conveyor is used to guide the movement of the flat can in the return path, in order to assist in the tilting of the flat can.

The flat can is held for this purpose by the traversing apparatus and is moved on the conveyor. The traversing apparatus is equipped with grasping arms at the ends of which grasping plates are provided. The traversing apparatus holds the flat can between the grasping plates. The tilting axis is constituted by the position of the grasping plates in the grasping arms.

The conveyor of the device has the advantage of being fixed, and of assisting the function of back-and-forth movement of the flat can as well as the function of tilting motion, whereby a tilting of the conveyor or an additional can conveying means are avoided. This advantage is achieved in particular in that the lower can rim (constituted by the can bead) is moved on rollers which are inclined towards each other with their rotational axes. This roller arrangement makes it possible for the flat can to be traversed as well as tilted on the conveyor. The tilting action on the conveyor is made possible because the lower can rim is able to slide continuously up and down against the inclined rollers.

In an advantageous embodiment of a tilter, the latter is made in the form of an eccentrically mounted roller. The roller is rotatably mounted in its eccentric rotary axis. At the same time the roller can be tilted and fixed continuously around its eccentric axis by means of an adjusting device. The flat can is guided between the two eccentrically mounted rollers. The rollers may be located in the lower or in the upper zone of the can. By tilting both rollers simultaneously by a common angle and in a common direction, the flat can is tilted around its tilting axis. The design of the tilters as eccentrically mounted rollers is especially advantageous because very little structural costs are required for tilting. The rollers ensure at the same time advantageous guidance of the flat can during traversing. An adjusting device controls the movement of the two rollers in function of the cuspidal points.

A thrust beam is another advantageous further development of the tilter. The thrust beams installed on either side near the longitudinal side of the flat can be operated independent of each other, yet can be synchronized in their interaction. The angle of tilt is adjustable through the control of the tilter.

The tilters furthermore make it possible to center the flat can in a basic position which is advantageous for can replacement and for precise guidance of the flat can during traversing in a tilted position.

Additional characteristic of the invention are indicated below in examples of embodiments and are explained through drawings.

DETAILED DESCRIPTION OF THE PREFERRED EMBODIMENTS

Figure 1:
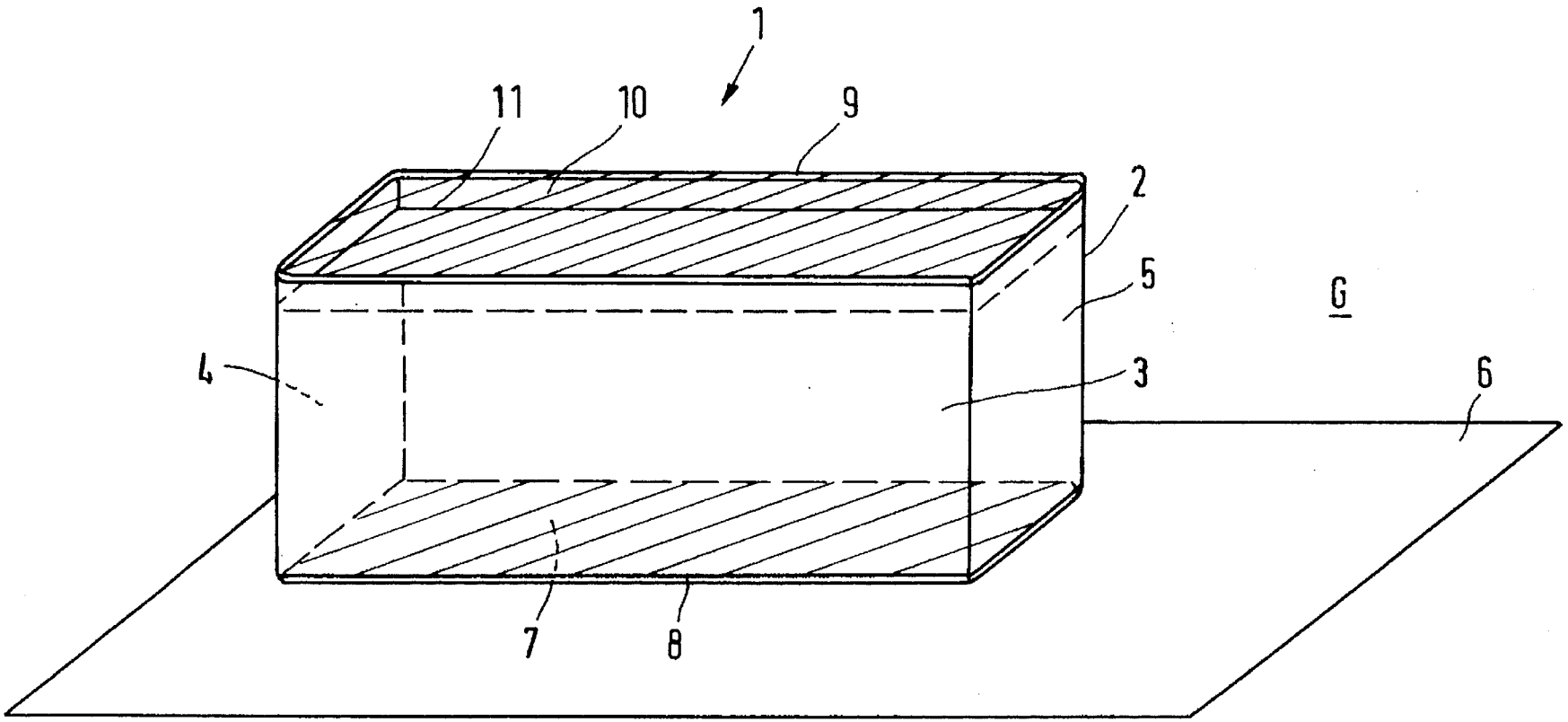
FIG. 1 shows a flat can.

Reference will now be made in detail to the presently preferred embodiments of the invention, one or more examples of which are illustrated in the drawings. Each example is provided by way of explanation of the invention, and not as a limitation of the invention. In fact, it will be apparent to those skilled in the art that various modifications and variations can be made in the present invention without departing from the scope or spirit of the invention.

According to the embodiment of the example illustrated, a flat can is standing under the rotary plate of a draw frame. The rotary plate is stationary in the machine table of the draw frame and is provided with a sliver guiding channel through which the fiber sliver leaves the rotary plate and is deposited in the flat can. Since the flat can is traversed over its entire length under the rotary plate, the fiber sliver is deposited cycloidally and in individual layers in the flat can. The flat can is substantially of oblong form, i.e. the lateral walls are considerably larger than the ends. FIG. 1 shows a normally used flat can. The outer form of the flat can is essentially constituted by the two long lateral walls 2 and 3 as well as of the two end surfaces 4 and 5. The walls 2, 3, 4 and 5 are perpendicular to their supporting surface 7. The supporting surface 7 of the flat can is located within the base surface 6 which represents the even floor. The delimitation of the walls 2, 3, 4 and 5 with respect to the base surface 6 is constituted by the can bead 8. The upper limit of the flat can is formed by the can bead 9. Within the can bead 9 constituting the upper delimitation of the can walls, a surface is formed, the surface being a depositing surface 10 which is parallel to the supporting surface 7 and thus also parallel to the base surface 6. As shall be explained further on, the position of the depositing surface 10 changes during tilting. This state of the flat can 1 of FIG. 1 is designated as a basic position G. The basic position G is advantageous for can replacement. The can plate 11 is positioned several centimeters below the upper can bead 9 when the flat can 1 is empty. The can plate 11 is pushed into this position by a pantograph as well as by annular springs. For reasons of clarity, this known mechanism of the can plate is not shown. As the weight of the deposited fiber sliver increases, the can plate 11 is pressed in the direction of the supporting surface 7.

Figure 2:
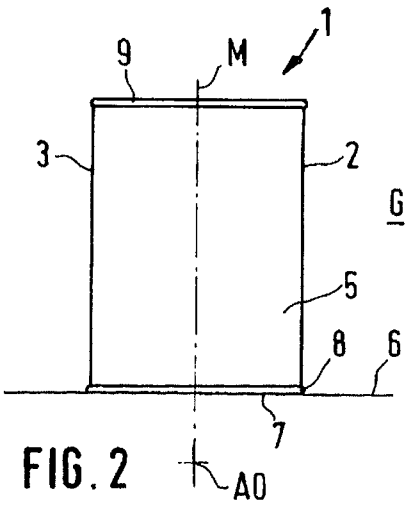
FIGS. 2–2*b* show the tilting of the flat can from its basic position.
Figure 2A:
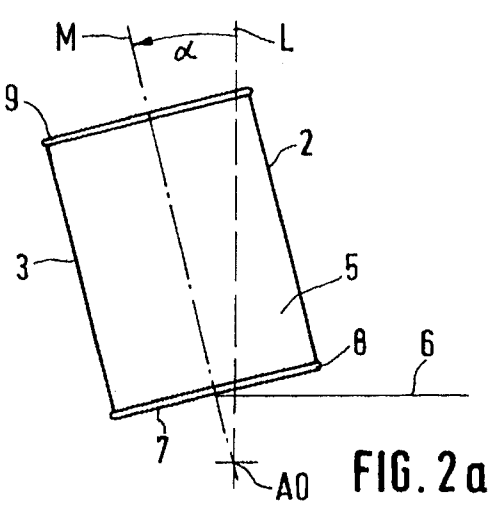
FIGS. 2*c*–2*e* show the tilting of the flat can from its basic position as the rotary plates and flat can are offset.
Figure 2B:
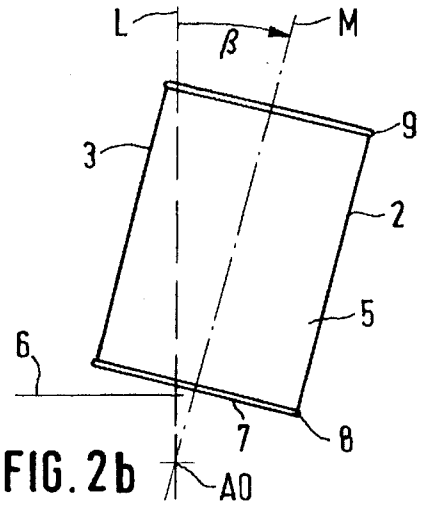

FIGS. 2, 2*a* and 2*b* show the tilting of the flat can. In FIG. 2 the front end of a flat can is shown. The front end 5 which is delimited by the lateral walls 2 and 3 as well as in part by the upper can bead 9 and the lower can bead 8 can be seen. The flat can 1 is standing here with its supporting surface 7 on the base surface 6. FIG. 2 helps in understanding a basic position G of the flat can to be defined. A flat can is however also in the basic position when the supporting surface 7 is placed above the base surface 6 and parallel with same. FIG. 2 furthermore shows a central vertical line M, located in the middle between the lateral walls 2 and 3, which is parallel to same and perpendicular to the supporting surface 7. The axis A0 around which the can 1 is to be tilted is a longitudinal axis which is perpendicular in relation to the central vertical line M, but is below the supporting surface 7. This state according to FIG. 2 is the basic position G of the flat can 1. As the filling process begins, the flat can is tilted into a position shown in FIGS. 2*a* or 2*b*. At the beginning of the filling process, as shown in FIG. 2*a* for instance, it is assumed that the flat can is starting in the return path. It is tilted within this return path by an angle $\alpha$ to its left side around axis A0. The tilting of a flat can with central vertical line M in relation to the plumb vertical L of a base surface 6 produces the angle $\alpha$. The upper can rim which is formed by the can bead 9 is offset laterally. This lateral offset of the upper can rim is essential because it results in a lateral offset of the depositing surface 10. Because of the variability and adjustability of the angles $\alpha$ and $\beta$ the depositing of the fiber sliver loops can be varied in relation to the lateral can rim. This is of great importance, for example when different fiber sliver materials are processed. The flat can is held and traversed to the opposite return path in this tilted position according to FIG. 2*a*. When the flat can arrives in the opposite return path, said flat can 1 is tilted in the opposite direction in relation to the plumb vertical L. This state is shown in FIG. 2*b*. The flat can 1 with central vertical line M was tilted back by an angle $\alpha$ and beyond this, was tilted in opposite direction by the angle $\beta$. The flat can is held in this tilted position (FIG. 2*b*) and is traversed as it leaves the return path. This process of tilting from the final position of angle $\alpha$ into the final position of angle $\beta$ and back is repeated periodically in the return paths. The flat can is traversed in tilted position. This represents a lateral shifting of the upper can rim of the flat can in relation to the direction of traversing. The lateral shift of the flat can through tilting achieves the result that the sliver loops can be deposited offset against the layer of sliver loops already lying directly below. The flat can is advantageously tilted by an angle such that the shift of the flat can is approximately equal to the thickness of the fiber sliver to be processed. It was found that this angle between the central vertical line M and the plumb vertical L may lie within a range of approximately 2°. The tilting of the flat can to one and later to the other side can result in the same angle size, i.e. the angles $\alpha$ and $\beta$ are of same size, but opposite in relation to the plumb vertical L.

The angle size is variable and adjustable.

This variability and adjustability of the tilting angle yields yet another advantage which was not obtained in the past in the high-speed range of filling flat cans. The deposit of the fiber sliver during traversing is subject to a certain influence. This influence results from the alternation effect between direction of fiber sliver deposit in relation to the direction of movement of the longitudinal side walls when fiber sliver and side wall come close to each other. This situation is commented through FIG. 13.

The upper can rim 500 of a flat can is shown. It is associated with a rotary plate 600. The flat can has a traversing speed with the direction of movement K. The rotary plate 600 has a rotational speed and a direction of rotation DR, whereby rotational forces R1, R2 occurring at the circumference influence the fiber sliver to be deposited. The influence also results from the movement of the flat can. The fiber sliver deposited by the rotary plate 600 into the flat can with upper can rim 500 is imparted a relative speed.

Figure 13:
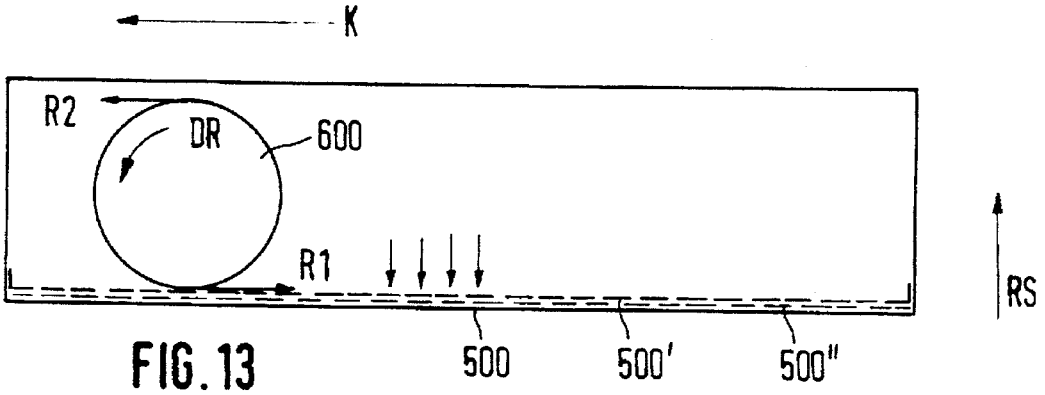
FIG. 13 shows the correction of influences during the deposit of the fiber sliver.

In the representation of FIG. 13 the velocity components of the rotary plate and of the flat can act in opposite direction near the wall 500. This results in a lower relative velocity of the fiber sliver in this area. The depositing radius of the fiber sliver becomes larger, i.e. the fiber sliver is deposited slightly closer to the can rim.

This effect can be taken into consideration thanks to the variability and adjustability of the angle by which the flat can is tilted, i.e. the tilting angle can be somewhat smaller than originally provided without taking into account the described effect, on condition that the can rim 500 is tilted so to meet the fiber sliver which is drifting outward at this location. Thus the can rim is not tilted as originally into position 500 but merely into the position of the upper can rim 500", assuming an "encountering" direction of tilt RS, i.e. the set angle is somewhat smaller than the originally provided angle of tilt. The situation is analogous for the return movement of the flat can.

A relative speed of the fiber sliver, leading to its being imparted a higher relative speed, is however also possible. In such case the fiber sliver is deposited slightly away from the wall. This effect can be compensated for by setting a wider angle than originally provided for the tilt of the upper can rim 500.

Figure 2C:
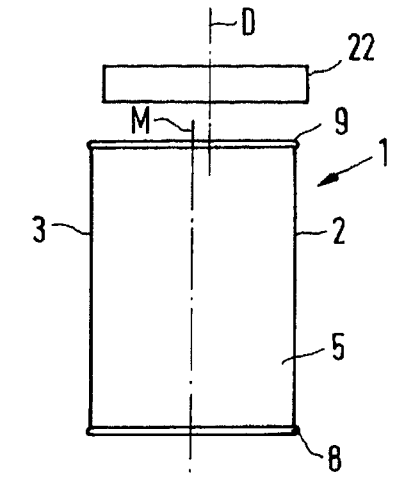
Figure 2D:
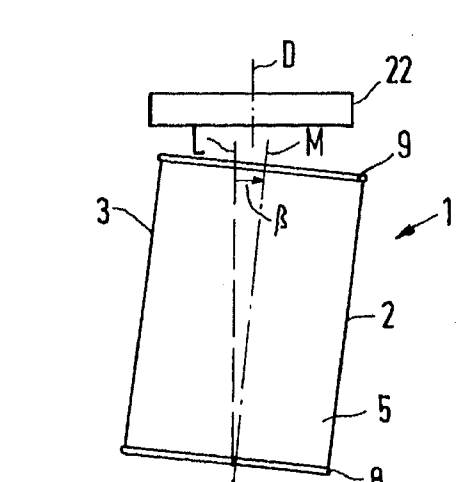
Figure 2E:
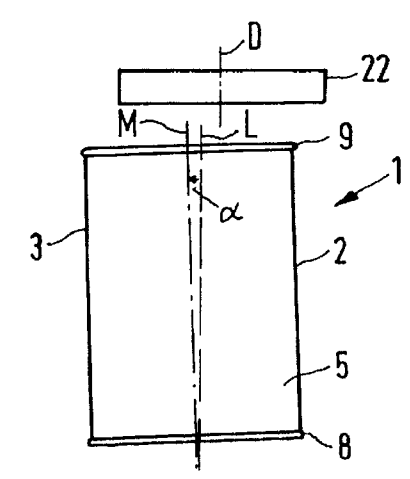

In practical application it may occur that the central vertical line M of the flat can is not exactly aligned with the rotary axis D of the rotary plate. FIG. 2*c* shows that the central vertical line M of the flat can 1 deviates from the rotary axis D of the rotary plate 22. This imprecise position between flat can and rotary plate influences the depositing of the sliver detrimentally. In order to compensate for this deviation between the central vertical line M of the flat can and the rotary axis D of the rotary plate, the flat can is tilted laterally at unequal angles (FIGS. 2*d*, 2*e*). As a subsequent comparison between FIG. 2*d* and FIG. 2*e* shows, the flat can according to FIG. 2*d* is tilted by a wider angle $\beta$ to correct the deviation than angle size $\alpha$ represented in FIG. 2*e*.

Figure 3:
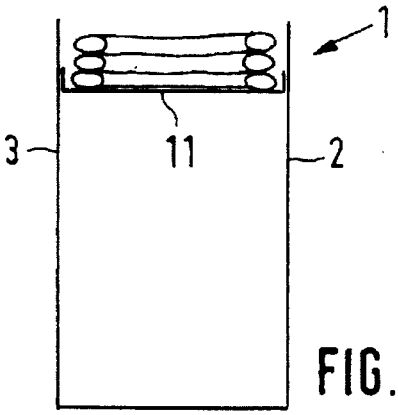
FIGS. 3–3*a* shows the deposit of fiber sliver in a flat can.
Figure 3A:
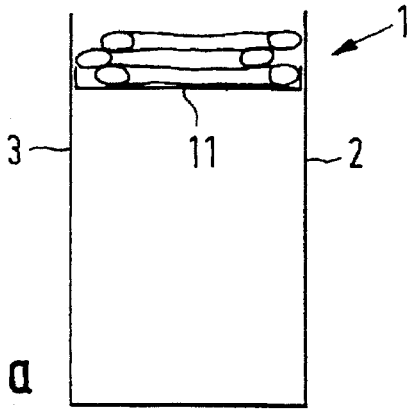

FIGS. 3 and 3*a* show the effect in sliver deposit which can be achieved by shifting the flat can by tilting it. This effect is the basis for the fact that the degree of fullness can be increased considerably over that of cans which are not shifted laterally.

FIG. 3 schematically shows several fiber sliver loops lying on top of each other when traversing takes place without lateral shift of the flat can. It can be seen that the fiber sliver is deposited so as to lie layer upon layer at the longitudinal lateral walls 2, 3. By contrast thereto, FIG. 3*a* shows the state of the fiber sliver when traversing takes place with lateral shift. It can be seen that the fiber sliver is offset laterally in relation to the fiber sliver directly below or directly above. The offset is approximately equal to the thickness of a fiber sliver. With this type of depositing the degree of fullness of the flat can may be increased, depending on the fiber material, up to 30%.

Figure 4:
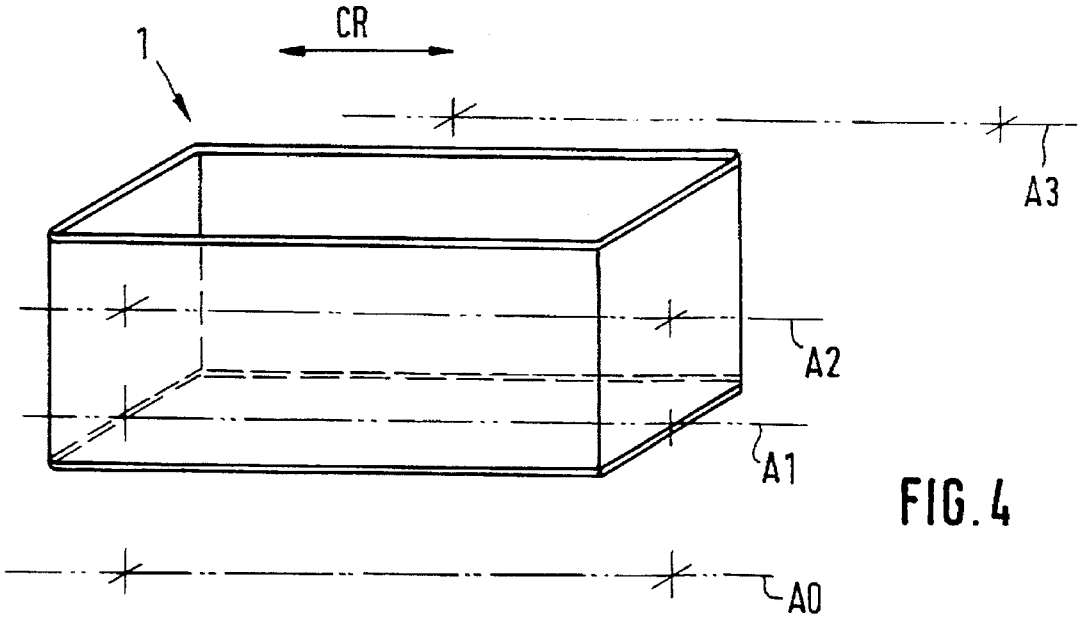
FIG. 4 shows axes for tilting.

The position of the axis around which the flat can is tilted is of great importance for the tilting of the flat can. In FIG. 4 several possibilities for the position of the tilting axis are shown schematically. The axis A2 is centrally symmetric. Another embodiment is the plumb vertical axis A1 below which is located in the supporting surface of the flat can. Even deeper, and thus outside the flat can, is the tilting axis A0. This case has already been shown in FIG. 2. With axis A3 the possibility is shown that it is also possible to tilt the flat can around an axis which is located outside the flat can and in proximity of one side wall. These different shown possibilities have in common that the axis around which the can is tilted is parallel to the traversing direction CR.

An advantageous solution is the position of axis A2. This axis is centered and symmetric in the can. This has the advantage that the axis A2 goes through the center of gravity of the can body and that the force needed to swivel the flat can is thus relatively lower than with the other possibilities shown.

Figure 5:
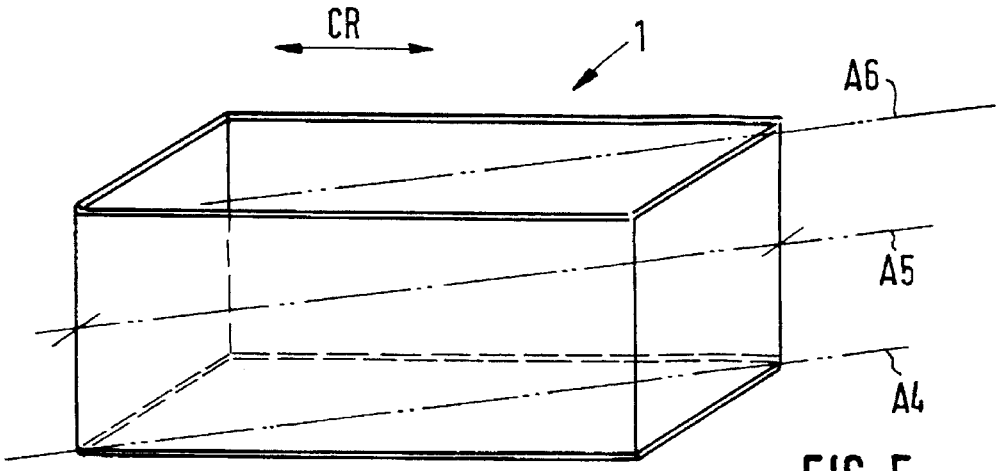
FIG. 5 shows axes for tilting.

To achieve a lateral transversal shifting of the flat can by tilting it, the axis may also be in a position which is not parallel to the traversing direction CR. Such possibilities are shown schematically in FIGS. 5 and 6. FIG. 5 shows the position of axis A4. This axis A4 is located in the supporting surface 7 of the flat can 1 and goes from one corner into the diagonally opposite corner of the flat can. This position of axis A4 is advantageous because the mass inertia can be used to advantage in this case. In the return path of each traversing action is a short segment in which the can is accelerated contrary to its original speed. This produces an inertia force of the center of gravity of the can in opposite direction which can be used as a driving force to tilt the flat can.

Figure 6:
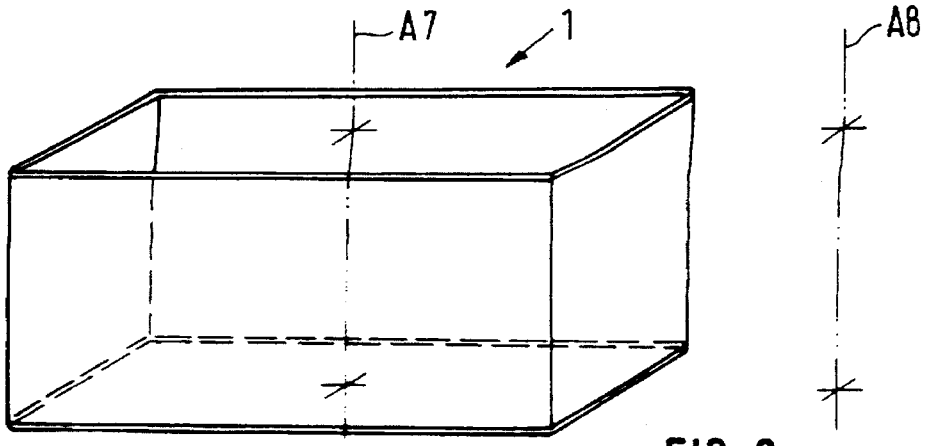
FIG. 6 shows axes for tilting.

FIG. 6 shows the possibility of laying out the axis for the tilting of the flat can vertically. Axis A7 is a vertically placed central axis around which the flat can may be tilted. As the position of axis A8 shows, the vertically laid-out axis may however also extend outside the flat can, advantageously in proximity of the front end. Swivelling around one of these shown axis also causes the fiber sliver to be offset as it is being deposited.

Figure 7:
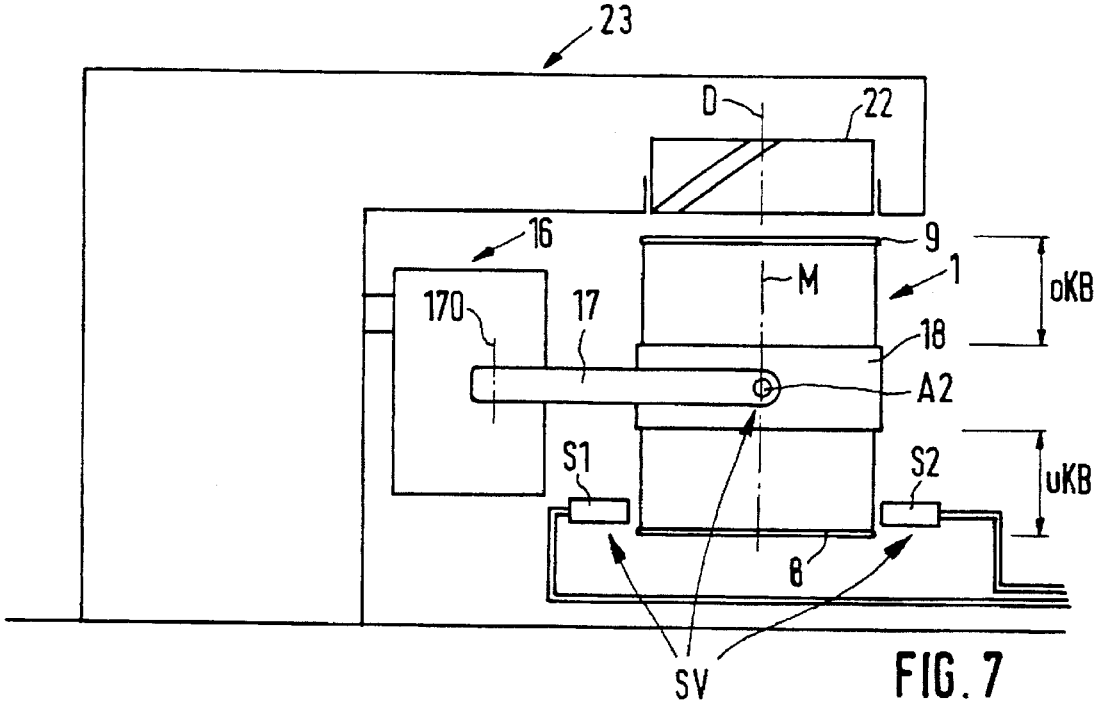
FIG. 7 shows a tilting device with traversing apparatus.
Figure 7A:
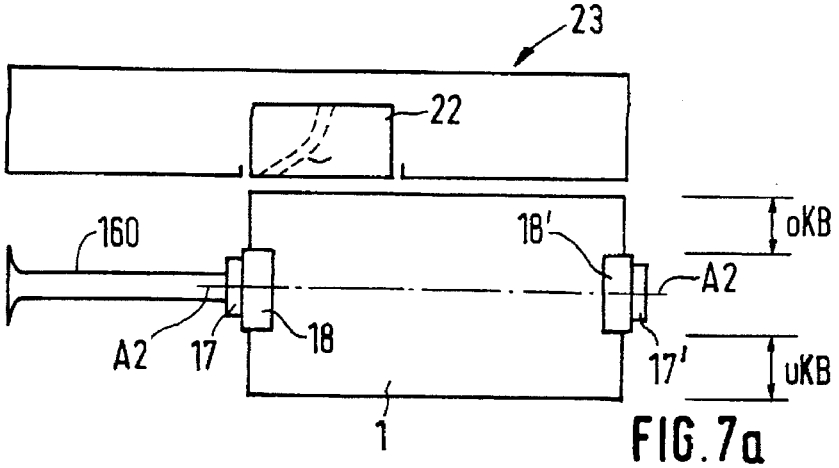
FIG. 7*a* shows a front view of FIG. 7.

FIGS. 7 and 7*a* show the basic design of a device for the traversing, according to the invention, of a flat can during the filling process. A flat can 1 is suspended under the rotary plate 22 of a draw frame 23. One of the end walls of the flat can is recognizable. The draw frame delivers the fiber sliver to the rotary plate 22 which deposits the fiber sliver (not shown here for the sake of clarity) into the flat can 1. The traversing apparatus 16 grasps the flat can 1 with a grasping arm and its swivelling grasper plate at each end wall.

FIG. 7*a* shows a view of the longitudinal walls of the flat can. It can be see clearly here that the flat can 1 is held tightly between the grasping plates 18, 18'. A state for can replacement is shown. The grasping plates 18, 18' are mounted pivotably and returnable in their grasper arms 17, 17'. This installation corresponds to a tilting axis, the axis A2.

The grasping arm 17 may be designed so as to be able to swivel around a vertical axis 170 in the traversing apparatus 16, so that it can be swivelled from a starting position (parallel to rail 160 of FIG. 7*a*) by 90° to grasp and hold the flat can (FIG. 7). On the other hand the grasping arm 17 is firmly fixed in its position for grasping and holding, i.e. the grasping arm 17 constitutes a stop for the new flat can to be inserted when a can is being replaced. This has the advantage that the flat can is thus positioned at the same time in relation to the traversing apparatus.

The flat can 1 is held by the traversing apparatus 16 and is traversed. Traversing takes place along a rail 160 which corresponds to a traversing path with the cuspidal points.

With respect to the can walls, an upper can zone oKB and a lower can zone uKB is represented on the two sides. The upper can zone oKB is a zone located between the upper can rim and a grasping plate holding the flat can. The lower can zone uKB is a zone located between the lower can rim and a grasping plate holding the flat can. The tilters S1, S2 can be assigned selectively to these can zones. The tilters S1, S2 can for example be placed in the upper can zone oKB. On the other hand, FIG. 7 shows a possible arrangement of the tilters S1 and S2 in the lower can zone uKB.

The tilting device SV in the example of FIG. 7 is constituted by the tilters S1, S2 and the axis A2. This tilting device SV is provided together with the traversing apparatus 16.

The tilters S1, S2 are located near the lower can bead 8. In their basic state the tilters S1, S2 are not in contact with the flat can 1. Before traversing starts, the tilters S1, S2 are put in operation, i.e. they provide a guidance to the flat can in its lower zone uKB. The tilters S1, S2 are thereby able to center the flat can in the basic position or to tilt it into a tilted position and give it guidance in this tilted position.

In each rerun path, the tilters S1, S2 are actuated so that they tilt the flat can to the right around axis A2 or to the left in its lower zone and guide it in one of these tilted position to the opposite cuspidal point in the traversing action. Upon completion of the filling process, the flat can 1 is again brought back into its basic position G, i.e. it is suspended and can be conveyed on a ready can magazine carriage (not shown). An empty can is taken from the can magazine carriage and is suspended in basic position G below the rotary plate 22.

Figure 8:
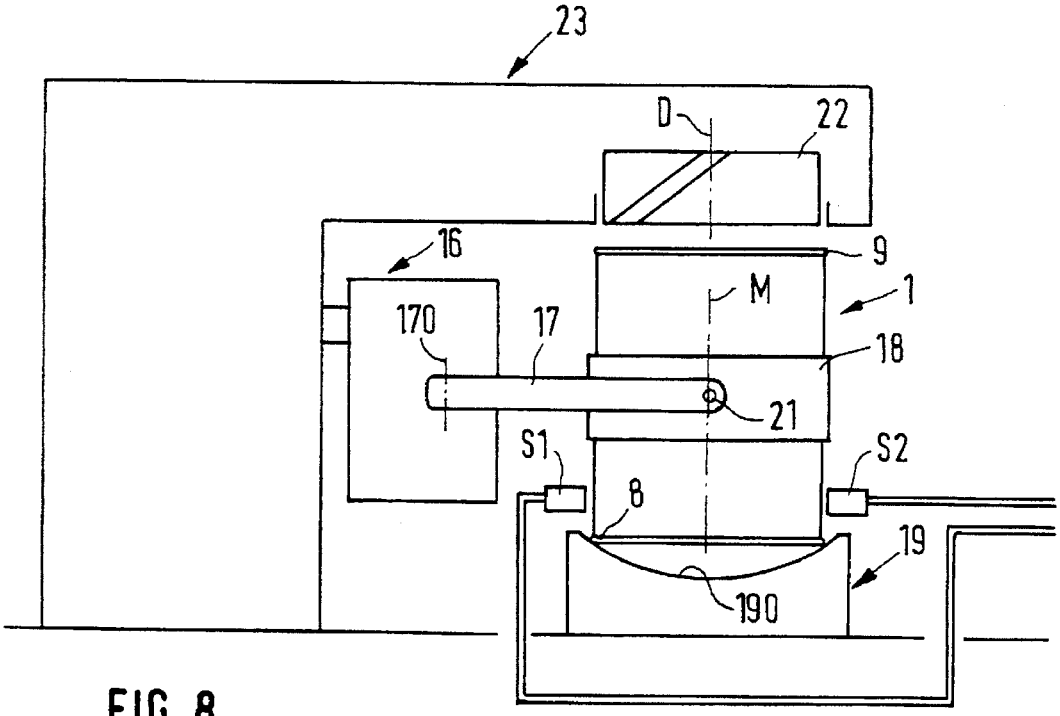
FIG. 8 shows a tilting device with conveyor.

In a special embodiment according to FIG. 8, the flat can 1 stands on a conveyor 19. The conveyor 19 is designed so that it permits the traversing motion as well as the tilting motion of the flat can 1. The contact surface 190 of the conveyor 19 is concave in form. The concave contact surface has its apex line in the lowest level. Due to this concave configuration of the contact surface 190, the flat can is standing on both sides with the lower can bead 8 of the lateral walls on the contact surface 190. This has the advantage that the contact surface 190 allows for a traversing motion as well as for a tilting motion of the flat can without any additional building costs. The conveyor 19 therefore needs no movable structures such as pushcarts to carry out the tilting motion of the flat can.

Figure 9:
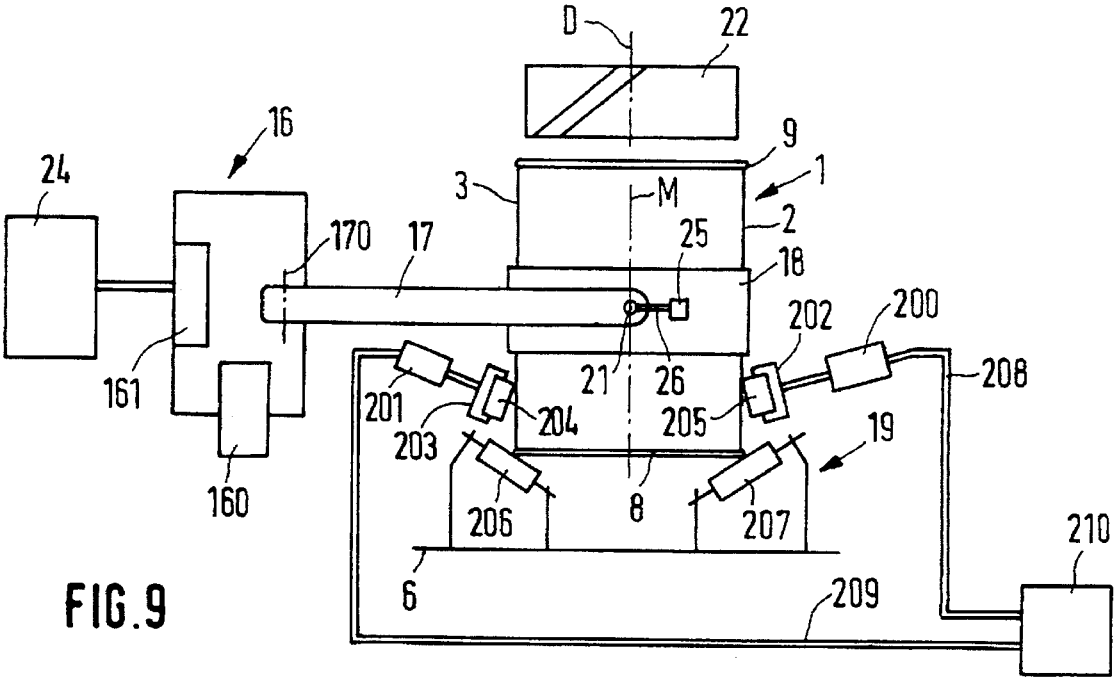
FIG. 9 shows a tilting device with conveyor in detail.

FIG. 9 shows a detailed example of an embodiment of a tilting device with a conveyor.

The flat can 1 is seen from the narrow end. The flat can 1 is standing on conveyor 19. The conveyor 19 consists of individual, rotatably mounted rollers which are placed next to each other over the entire length of the traversing path. To represent them, rollers 206 and 207 are shown. It can be seen that these rollers are inclined at an angle, which may be 12° for example, in relation to the base surface 6. The rollers 206, 207 are placed with their generating line in such manner that the generating line follows cut-outs from the concave inclined contact surface 190. This inclination of the rollers causes the flat can 1 to stand with its can bead 8, which delimits the longitudinal side walls 2 and 3, on the right-side rollers (symbolized by the roller 207), and on the left-side rollers (symbolized by the roller 206). In the position shown the flat can is in its base position G. The central vertical line M of the flat can 1 coincides with the plumb vertical L of the base surface 6 (compare with FIG. 2). In this base position G, the flat can 1 may be immediately before the start of the filling process. The rotary plate 22 is also still in its rest position.

The traversing apparatus 16 has its own drive 24 with controls and transmits the force to a coupling mechanism 161. In operation, the coupling mechanism 161 makes it possible for the traversing apparatus 16 to be moved on the rail 160. As one of the cuspidal points of the traversing path is reached, the coupling mechanism 161 receives a signal in a known manner for alternating coupling, so that a reversal of the direction of travel is possible.

In FIG. 9 the traversing apparatus 16 has swivelled the swivelling grasping arm 17 around the vertical swivelling axis 170 in the direction of the narrow front end of the flat can 1. The grasping arm 17', which is not shown here, has grasped the opposite front end which is not visible in FIG. 9. The further descriptions are limited to the grasping arm 17 which is shown here, but they apply similarly to the other grasping arm 17' which is not visible in the figure. The grasping arm 17 is equipped with a grasping plat 18 which tightly grasps the front end of the flat can 1. The grasping plate 18 is here pivotably mounted in the grasping arm 17 by means of axis 21. Axis 21 has here the same function as a tilting axis A2.

FIG. 9 furthermore show two thrust beams 202, 203 installed in the lower can zone uKB as other possible tilters.

Figure 10:
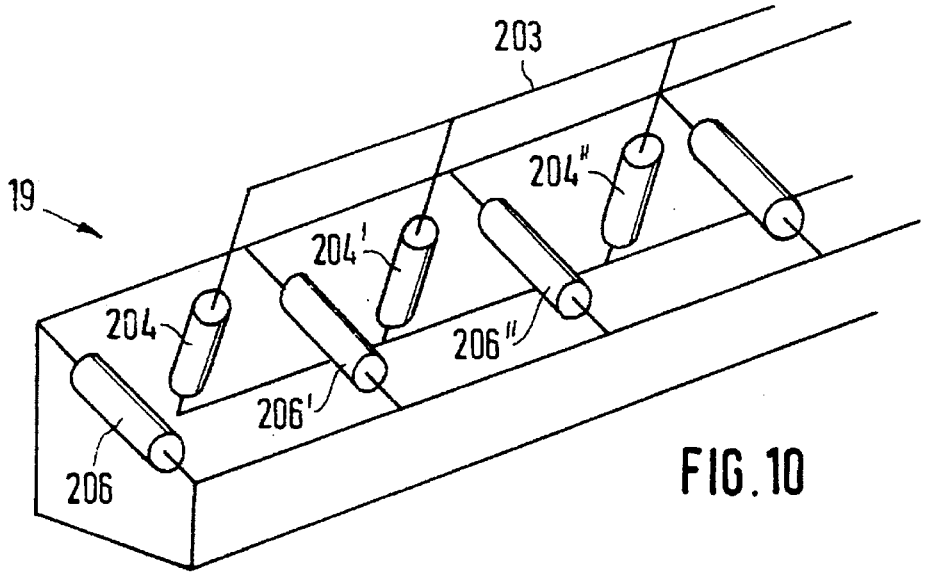
FIG. 10 shows the conveyor with thrust beams.

Each of the thrust beams 202, 203 has a length that extends beyond the length of the flat can. Individual rollers are installed next to each other in each of the thrust arms 202, 203. The axes of rotation of these rollers are inclined at an angle relative to the central vertical line M. These and additional details concerning the thrust beams are shown in FIG. 10. The drawing is only schematic and shows a detail of the conveyor 19 and the associated thrust beam 203. The partial conveyor 19 is characterized by the inclined rollers 206, 206' and 206". Thrust beam 203 is installed above these rolls. It supports the rollers 204, 204' and 204" on a frame. The axes of rotation of these rollers are in a plane which is at an angle of approximately 78° to the base surface. This thrust beam 203 is able to move freely in a perpendicular direction to the conveyor 19. The opposite thrust beam 202 (not shown in FIG. 10) is also able to move freely in a perpendicular direction. The axes of rotation of the rollers of both thrust beams are inclined in relation to each other in such manner that the imaginary prolongation of their axes of rotation meet above the conveyor. The two thrust beams 202, 203 can be controlled by controls 210 in such manner that their movements can be controlled independently of each other and this makes it possible not only to vary the size of the angle but also to obtain unequal angles $\alpha$ and $\beta$ in tilting. This makes it possible to keep one of the to angles narrower or wider than the other angle. An offset of the central vertical line M in relation to the axis of rotation D of the rotary plate can thereby be compensated for.

The thrust beam 202 is connected to the pneumatic cylinder 200, and the same applies to the thrust beam 203 and the pneumatic cylinder 201. The pneumatic cylinders 200, 201 are fed compressed air via a pneumatic circuit 208, 209 under the control of controls 210, so that the thrust beams 202, 203 can be moved towards or away from the can in accordance with their inclined position. The flat can placed on the conveyor 19 can thus be centered in a basic position G.

Starting from the described position G, the flat can is to be brought into a tilted position. For this purpose the pneumatic cylinder 201 is emptied of compressed air in a defined manner and the pneumatic cylinder 200 is put under definitive pressure in counter-play. This alternation of the pneumatic cylinders 200, 201 also causes the lower half of the flat can 1 to be tilted around axis 21 in direction of the left side of the drawing. The can rim with can bead 8 of the can wall 3 slides up on rollers (roller 206 is shown symbolically in FIG. 9) while the can rim with can rim 8 of can wall 2 slides down on the rollers (roller 207 is shown symbolically in FIG. 9). The can is held in this position. Due to the tilting of the flat can and of the grasping plate 18, the leaf spring 26 which is held in holder 25 is put under tension. The same applies to a leaf spring of the grasping plate 18'. The tilted position of the flat can 1 is maintained by the thrust beams 202, 203.

The filling of the flat can begins in this position. The flat can is traversed in its tilted position to the opposite return path. It slides along the rollers which are installed in the thrust beams. As soon as the controls of the traversing apparatus 16 recognize that the flat can 1 has reached the return path, the tilters with the thrust beams are again actuated. This is done in that the pneumatic cylinder 201 is now subjected to a defined force while the pneumatic cylinder 200 is equally relieved in a defined manner via controls 210. These movements of the pneumatic cylinders cause the thrust beam 203 to push the lower can rim in the direction of the right side of the drawing (FIG. 9). The can rim slides down on roller 206 in this process. Since the pneumatic cylinder 200 is relieved with a defined force, it yields in counter-movement to the movement of the can rim which slides up on roller 207. This alternation of the pneumatic cylinders 200, 201 is terminated when the can has been tilted in the opposite direction by the same angle in relation to the central vertical line M. This change of direction of the tilting movement is completed even before the flat can leaves the return path and moves again towards the other return path in this tilted position. In course of this action the grasping plate 18, 18' is also swivelled around axis 21, i.e. the leaf spring 26 is also released and is put under tension in the opposite direction.

Figure 11:
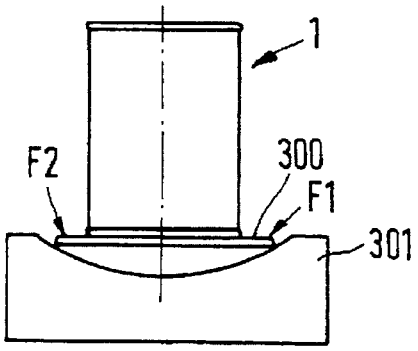
FIG. 11 shows the tilting of the flat can effected by two conveyors.

FIG. 11 shows a principle by which the flat can is standing on a flat conveyor 300 and in which this flat conveyor 300 is in turn installed in a concavely cambered conveyor 301. The tilter alternately apply a force F1, F2 which causes the conveyor 300 to tilt within the conveyor 301.

Figure 12:
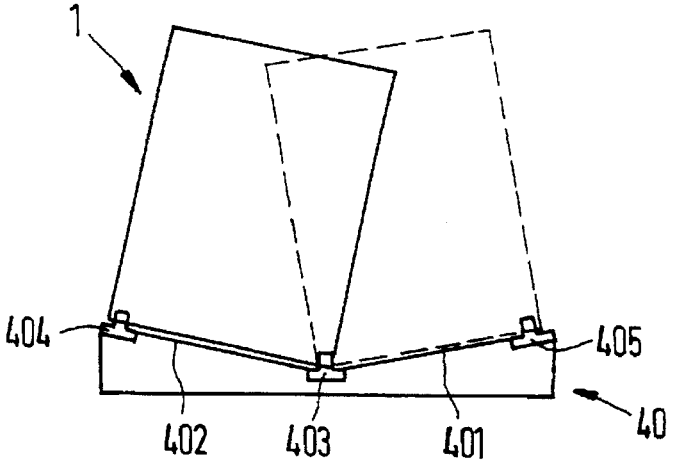
FIG. 12 shows the tilting of the flat can with the rail system of a conveyor.

FIG. 12 shows the basic principle of another embodiment. According to the example of FIG. 12, tilting is not achieved by using the tilters but by a forced guidance of a flat can by means of a rail system (403, 404, 405) The rail system is installed in a concavely cambered conveyor 40. The flat can 1 is moved alternately on rails 403, 404 or 403, 405. In each return path of the traversing path a switch is provided (not shown here) which guides the flat can from one rail way 403, 404 to the other rail way 403, 405, and vice versa. The flat can is thus forced to move on the angled sides 401, 402 of the conveyor 40.

Figure 14:
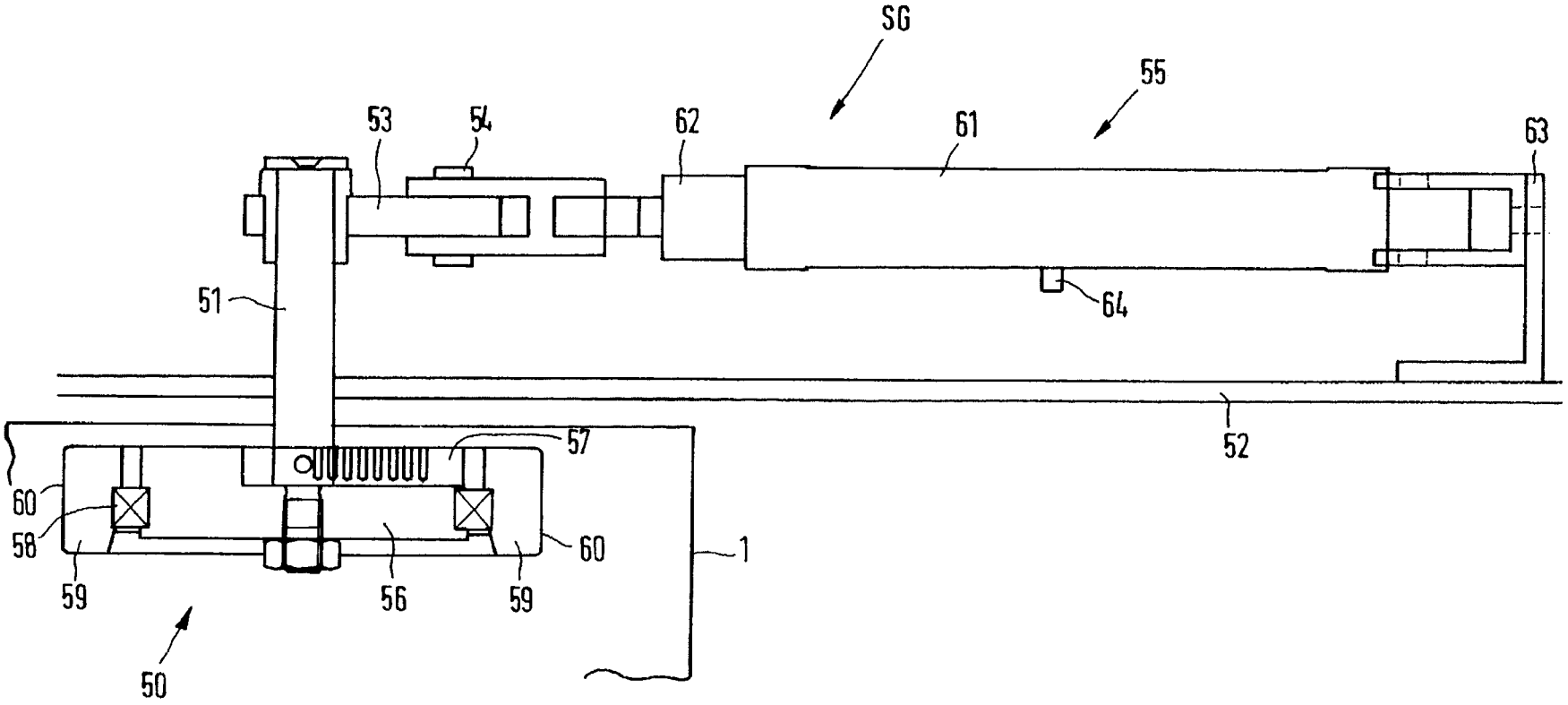
FIG. 14 shows tilter in the form of eccentrically adjustable rollers.

FIG. 14 shows yet another advantageous embodiment of a tilter SG. The tilter SG consists of a roller 50 which is eccentrically mounted in an axis 51. FIG. 14 shows for example that roller 50 and axis 51 are located below the machine table 52 of the fiber sliver depositing apparatus of a draw frame. A flat can 1 is placed under the machine table 52 to be traversed. Furthermore the tilter SG consists of an adjusting cable 53 with axis 54 and of an adjusting device 55. The adjusting lever 53 with axis 54 and the adjusting device 55 are located above the machine table and do not interfere with the movement of a flat can.

The roller 50 consists in particular of an eccentricity hub 56 which is installed eccentrically in axis 51. The eccentricity hub 56 is fixedly connected to axis 51 by means of a detachable screw connection. The eccentricity hub 56 is provided with an oblong opening 57 with adjustable screen. The oblong opening 57 provides the possibility of adjusting and fixing the eccentricity of the eccentricity hub 56 in steps. An adjustment of the eccentricity may be necessary, for example, if different can sizes or a change in the tilting angle become necessary.

The eccentricity hub 56 is provided with a ball bearing ring 58. A roller collar 59 is supported rotatably with its circumferential surface 60 on this ball bering collar 59. The axis 51 is fixedly connected to an adjusting lever 53. The adjusting lever 53 is mounted rotatably in axis 54. The adjusting device 55 is similarly mounted in axis 54. The adjusting device 55 may be in the form of a pneumatic cylinder 61 with piston rod 62, for instance. However other types of adjusting devices with different physical action, such as electro-mechanical or hydraulic adjusting devices may also be used.

According to FIG. 14, the piston rod 62 is engaged in axis 54. The pneumatic cylinder 61 is held by a corner element 63 which is attached to the machine table 52. The pneumatic cylinder 61 is furthermore provided with a connection 64 for a control circuit leading to a control device. A tilter SG is installed on either side of the traversing path of a flat can, preferably at the return path. The placement may be optionally near the lower can zone or the upper can zone. In FIG. 14 for example, the tilter SG is shown as being placed in proximity of the upper can zone oKB.

Figure 16:
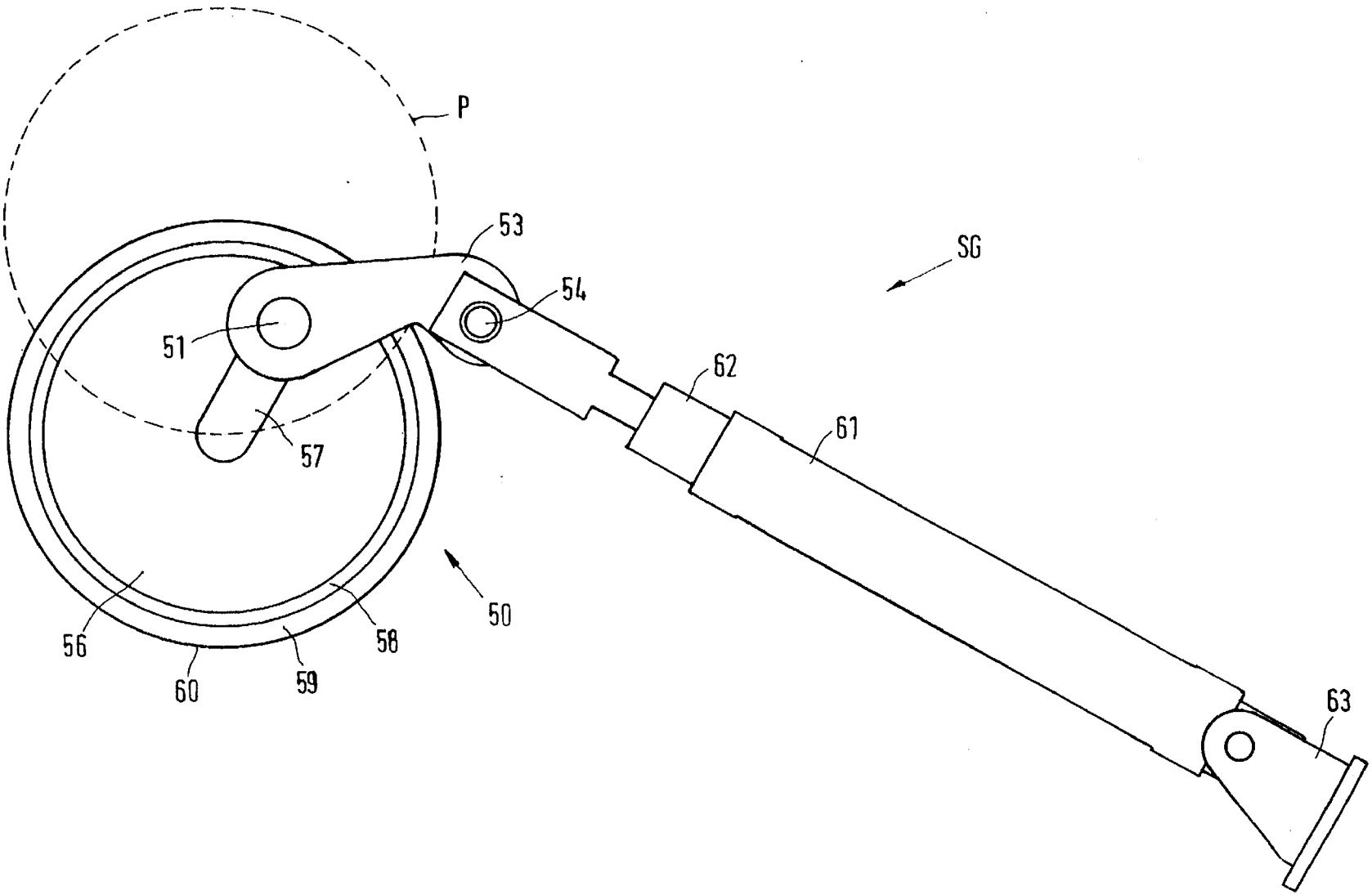
FIG. 16 is a top view of the tilter according to FIG. 14.

FIG. 16 shows a top view of the tilter SG of FIG. 14. FIG. 16 shows that the roller 50 can be tilted and adjusted between the shown position and the position P indicated by a broken line. For this the piston rod 62 must be pulled or pushed.

Figure 15:
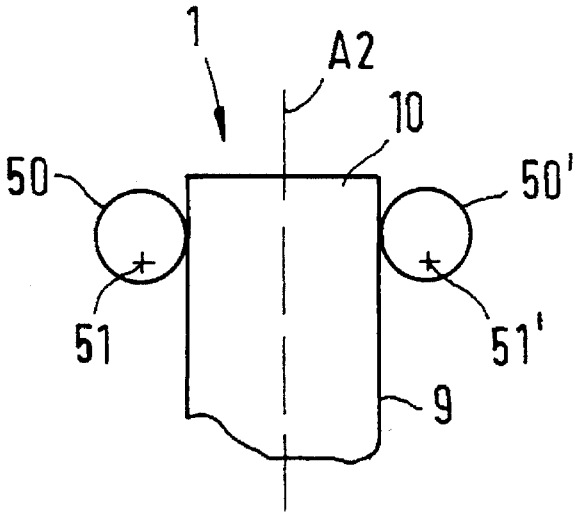
FIGS. 15–15*b* shows the operation of the tilters with eccentrically adjustable roller.
Figure 15A:
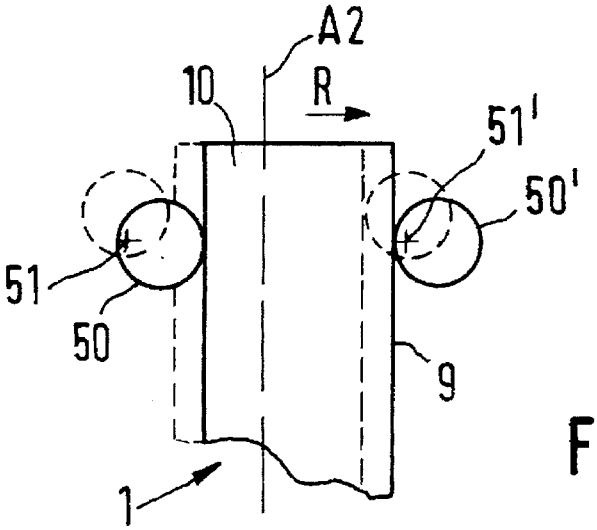
Figure 15B:
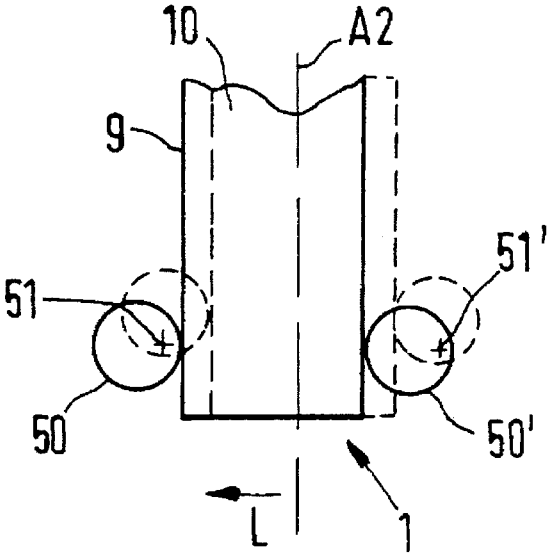

The operation of the tilter SG of FIG. 14 is explained through FIGS. 15 to **15*b*. FIG. 15 shows an empty can which is placed into exchange position in the course of a can replacement. FIGS. 15*a* to 15*b* show a view from the lower side of the machine table 52 on the depositing surface 100 of a flat can with upper can rim 9**.

The two rollers 50, 50' with their eccentric axis 51, 51' are shown schematically as placed in the upper can zone, at the upper edge 9. In a can replacement, the rollers 50, 50' are spread away from the upper rim 9 of the flat can 1 so that no contact is made with the flat can. According to FIG. 15 the flat can is already in exchange position and the rollers 50, 50' are set by means of adjusting devices on the upper can rim. The circumferential surface 60 of the roller collar 59 is applied against the can rim 9. FIG. **15*a* shows the preparation for a traversing position of the flat can. The arrangement according to the broken line shows the state by comparison with FIG. 15. In the comparison between FIGS. 15 and 15*a*, the eccentrically mounted rollers 50, 50' are swivelled together by a defined amount around their axes 51, 51' in direction R. This swivelling of the roller 50 can be effected by the thrust of the piston rod 62, for example. The adjusting lever 53 rotates the eccentricity hub 56 via axle 51. In opposition to the pull of the piston rod, the swivelling of roller 50' is realized. The consequence is a tilting of can 1 in direction R around a shown axis A2. The traversing of the flat can begins in this position and the rotary plate deposits the fiber sliver cycloidally. In the position according to 15*a*, the flat can is traversed to the rerun path of the traversing path. This is shown in FIG. 15*b*. The rollers 50, 50' are now moved in opposite direction around axes 51, 51'** via the respective piston rod. Tilting of the flat can in opposite direction L results from this.

The tilter SG may also be used in the lower can zone uKB. The tilter SG requires only little construction outlay, it is low-cost and requires little maintenance.

It will be apparent to those skilled in the art that various modifications and variations can be made in the invention. For example, features illustrated or described as part of one embodiments may be used on another embodiment to yield a still further embodiment. It is intended that the invention include such modifications and variations as come within the scope of the appended claims.

We claim:

1. A textile machine configured for delivering a fiber silver to a flat can having an elongated cross-section elongated in a longitudinal direction, said machine comprising a traversing device for imparting a traversing back-and-forth movement to said flat can in said longitudinal direction beneath a stationary rotary plate, said traversing device comprising grasping arms configured with grasping plates for grasping said flat can and imparting said traversing movement thereto, said traversing device further comprising means for alternately tilting said flat can in opposite directions around a tilting axis for each back-and-forth movement of said flat can at a predetermined angle, said flat can defining a depositing plane which is delimited by a can bead at the top of said flat can, said tilting means configured to alternately tilt said flat can such that said depositing plane is shifted laterally at each change of direction of said flat can in its back-and-forth movement in a direction essentially perpendicular to said longitudinal direction in a defined manner and held in said laterally shifted position for the length of travel of said flat can in said longitudinal direction so that fiber silver deposited in the flat can is offset laterally in alternate directions with respect to said longitudinal direction within the flat can.

2. The textile machine as in claim 1, wherein said tilting means comprises oppositely facing tilters disposed so as to contact opposite long sides of said flat can during its traversing movement.

3. The textile machine as in claim 2, wherein said tilters are disposed at a height so as to contact said flat can at an upper can zone thereof above said grasping plates.

4. The textile machine as in claim 2, wherein said tilters are disposed at a height so as to contact said flat can at a lower can zone thereof below said grasping plates.

5. The textile machine as in claim 2, wherein said tilters comprise oppositely facing thrust beams.

6. The textile machine as in claim 5, wherein said thrust beams comprise a length at least as long as said flat cans in said longitudinal direction and further comprise a plurality of thrust beam rollers disposed therealong.

7. The textile machine as in claim 6, wherein said thrust beam rollers comprise axes of rotation in a plane inclined towards said flat can.

8. The textile machine as in claim 2, wherein said tilters comprise oppositely facing eccentrically mounted rollers.

9. The textile machine as in claim 8, wherein said each eccentrically mounted roller comprises an eccentricity hub and a rotatable roller collar which is rotatable relative said hub.

10. The textile machine as in claim 9, wherein said eccentricity hub comprises an oblong opening defined therein for adjusting the eccentricity of said eccentrically mounted roller.

11. The textile machine as in claim 8, further comprising an adjusting device for adjusting and fixing said eccentrically mounted roller about an axis.

12. The textile machine as in claim 1, wherein said graspers and grasper plates are disposed so that said flat can hangs in said traversing device, said tilting device tilting said flat can as it hangs.

13. The textile machine as in claim 1, wherein said traversing device further comprises a conveyor upon which said flat can is placed.

14. The textile machine as in claim 13, wherein said conveyor is configured to tilt with said flat can and said tilting device is configured to tilt said flat can and said conveyor.

15. The textile machine as in claim 13, wherein said conveyor comprises a concave contacting surface upon which said flat can is placed so that said flat can is tiltable on said conveyor.

16. The textile machine as in claim 15, further comprising oppositely facing rollers disposed relative a longitudinal apex line of said concave contacting surface so as to contact a lower can bead of said flat can.

17. The textile machine as in claim 16, wherein said rollers comprise an inclined axis of rotation.

18. The textile machine as in claim 1, wherein said grasping arms with said grasping plates are swivelable about a longitudinally extending axis.

19. The textile machine as in claim 1, wherein said tilting axis comprises a longitudinal axis which is essentially parallel to the traversing direction of said flat can.

20. The textile machine as in claim 19, wherein said longitudinally extending tilting axis lies within and parallel to longitudinally extending lateral walls of said flat can.

21. The textile machine as in claim 20, wherein said longitudinally extending tilting axis comprises a centrally symmetrical longitudinal axis of said flat can.

22. The textile machine as in claim 19, wherein said longitudinally extending tilting axis lies outside longitudinally extending lateral walls of said flat can.

23. The textile machine as in claim 22, wherein said tilting axis lies adjacent a said longitudinally extending lateral wall of said flat can.

24. The textile machine as in claim 19, wherein said longitudinally extending tilting axis lies within a supporting surface of said flat can.

25. The textile machine as in claim 19, wherein said longitudinally extending tilting axis lies below a supporting surface of said flat can.

26. The textile machine as in claim 1, wherein said tilting axis is essentially non-parallel to the traversing direction of said flat can.

27. The textile machine as in claim 26, wherein said tilting axis is essentially a diagonal longitudinal axis in a plane essentially level with said flat can.

28. The textile machine as in claim 27, wherein said tilting axis lies essentially between longitudinally extending side walls of said flat can.

29. The textile machine as in claim 27, wherein said tilting axis lies essentially outside longitudinally extending side walls of said flat can.

30. The textile machine as in claim 27, wherein said tilting axis lies diagonally within a supporting surface of said flat can.

31. The textile machine as in claim 26, wherein said tilting axis is essentially perpendicular to the traversing direction of said flat can.

32. The textile machine as in claim 31, wherein said perpendicular axis lies within said flat can.

33. The textile machine as in claim 31, wherein said perpendicular axis lies outside said flat can.

34. The textile machine as in claim 1, wherein said tilting means comprises a conveyor.

35. The textile machine as in claim 34, wherein said conveyor is concavely cambered with angled sides, said flat can being alternately set against said angled sides by said tilting means.

36. The textile machine as in claim 35, further comprising a rail system configured with said angles sides, said flat can traversing on alternate rails of said rail system in its back-and-forth traversing movement.

37. The textile machine as in claim 36, wherein said rail system further comprises a switching device disposed at positioning where said flat can changes direction in its traversing movement, said switching devices configured to switch said flat can to said alternate rails.

* * * * *